United States Patent [19]

Enterante, Sr. et al.

[11] Patent Number: 4,909,270

[45] Date of Patent: Mar. 20, 1990

[54] ANTI-SIPHON FROST FREE FAUCET

[75] Inventors: Louis F. Enterante, Sr., Encino; Louis F. Enterante, Jr., Glendale; Frank L. Enterante, Northridge, all of Calif.

[73] Assignee: Arrowhead Brass Products, Inc., Los Angeles, Calif.

[21] Appl. No.: 408,369

[22] Filed: Sep. 18, 1989

[51] Int. Cl.[4] ..... F16K 24/02

[52] U.S. Cl. ..... 137/107; 137/218; 137/360

[58] Field of Search ..... 137/107, 218, 360

[56] References Cited

U.S. PATENT DOCUMENTS

| | | | |
|---|---|---|---|
| 3,424,189 | 1/1969 | Woodford | 137/218 |
| 4,117,856 | 10/1978 | Carlson | 137/218 X |
| 4,700,732 | 10/1987 | Francisco | 137/17 |
| 4,821,762 | 4/1989 | Breneman | 137/218 |

*Primary Examiner*—Robert G. Nilson

*Attorney, Agent, or Firm*—Harlan P. Huebner

[57] ABSTRACT

An anti-siphon frost free faucet having a neck portion that includes an anti-siphon back flow preventer interposed between the neck and a hose, a water drain means positioning at the lowest point in said faucet to facilitate complete water drainage of said faucet when a supply of water to said faucet is turned off and an air vent means on said faucet operable when said supply of water is turned off to allow air into said faucet to assure optimum pressure operate said drain means.

7 Claims, 2 Drawing Sheets

ANTI-SIPHON FROST FREE FAUCET

BACKGROUND OF THE INVENTION

1. Field of the Invention.

This invention relates to an anti-siphon faucet that is capable of complete water drainage from that portion of the faucet that projects into the atmosphere from a building so as to prevent water from freezing therein in below freezing weather.

2. Description of the Prior Art.

There has been some prior work in the development of anti-siphon frost free faucets. However, in the developments of such faucets a major problem has developed. Generally, the faucet construction has not allowed complete emptying of the faucet at the water discharge end.

There have been facets that possess a vacuum breaker (anti-siphon) feature and back flow preventer means. Such a faucet is shown in U.S. Pat. No. 3,414,001 to Woodford. However, this patent does not have separate air vent and drainage combination means to allow drainage of water in the faucet when the water source is turned off.

U.S. Pat. No. 3,494,373 to Horak is for a frost free faucet but it calls for removal of a part of the faucet at the building wall to prevent vandalism. Further, should the removable section be left in the faucet mounted in the wall when the water is turned off water in the removable section would not be completely drained.

Finally, applicants are knowledgeable of U.S. Pat. No. 3,929,150 which illustrate a back flow preventer and anti-siphon means, however, the valving is complicated and requires an internal tube within an outer tube to provide two passages so that one may communicate with a bleed off valve. However, again there is no full assurance that without water pressure full drainage of the internal tube can be accomplished.

SUMMARY OF THE INVENTION

It is a purpose of the present invention to provide a faucet that includes anti-siphon or back flow preventer means as well as a vent means to assure proper air flow and drain means to achieve complete evacuation of water therein to prevent water from freezing within the faucet during freezing weather.

Another object of the present invention is to provide an interior area of a nozzle or water faucet that is structured to allow water from a hose coupling portion to drain away from said coupling to assure water evacuation A still further object of the present invention is to provide a pressure actuated drain to allow water within said faucet to be completely evacuated.

A yet further object of the present invention is to provide a vent means that can control the flow of air into the faucet and prevent a vacuum from forming inside of said faucet.

Another object of the present invention is to provide an elongated valve seem attached to a water valve remote from said faucet to control the flow of water from a water source and further prevent freezing of water in said faucet.

A still further object of the present invention is to provide a new anti-siphon frost free faucet that is economical to manufacture and relatively uncomplicated in construction.

These and other objects and advantages will become apparent from the following part of the specification wherein details have been described for the competence of disclosure, without intending to limit the scope of the invention which is set forth in the appended claims.

BRIEF DESCRIPTION OF THE DRAWINGS

These advantages may be more clearly understood from the following detailed description and by reference to the drawings in which.

DETAILED DESCRIPTION OF THE PREFERRED EMBODIMENT

Figures 1, 2:
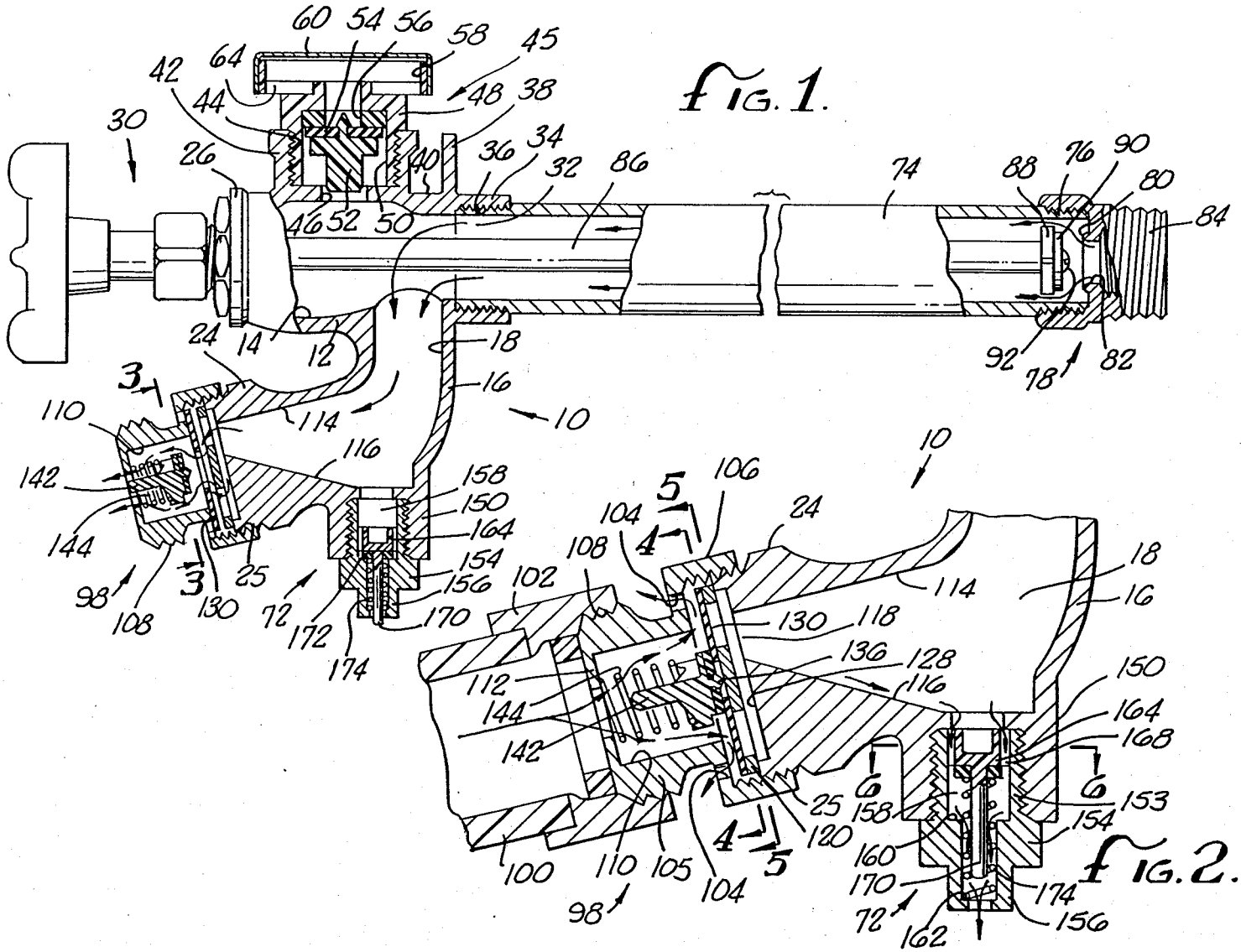
FIG. 1 is a side elevational partial sectional view of the present faucet.
FIG. 2 is an enlarged sectional view of a portion of the faucet of FIG. 1 with the back flow preventer in a closed position and the drain in an open position.
Figure 3:
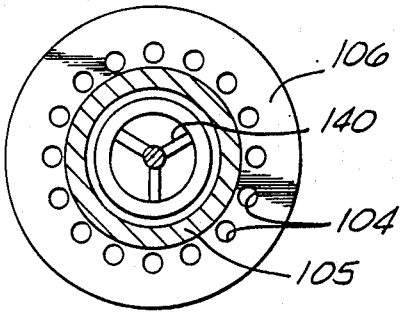
FIG. 3 is an elevational view taken on line 3—3 of FIG. 1 of a portion of the back flow preventer means.

In FIG. 1 the entire faucet is generally designated 10 and may be made of brass or other suitable material. The faucet 10 is preferably cast as a single structure that has a body portion 12 that includes a generally elongated horizontal first cavity 14.

Communicating with the body portion 12 is a neck portion 16 having a second cavity 18 depending down from the cavity 14 and commuting therewith.

At the front end 24 of the neck portion 16 there are threads 25 formed thereon. At the front end 26 of the body 12 the interior of the cavity 14 adjacent the front end 26 is fitted with threads (not seen) to receive a conventional valve handle means 30. The handle means 30 is threaded into the cavity 14 and is adapted to control a water source.

The faucet 10 has an opening 32 opposite the front end 26 with a collar 34 projecting outwardly from the body 12. The collar 34 includes internal threads 36. Projecting radially outwardly from the body 12 adjacent the collar 34 is a wall mounting flange 38 to mount the faucet 10 to the outside of a building wall (not seen).

At the top 40 of the body portion 12 there is a vent collar 42 having internal threads 44. An opening 46 allows communication between the cavity 14 and interior of vent collar 42. Threadably secured within the vent collar 42 is a vent means designated 45 that includes a vent valve body 48, which may be formed of plastic or other material.

The vent valve body 48 includes a cavity 50 with a plurality of space ribs (not shown) around the cavity. Mounted within the cavity 50 is valve pluger 52 adapted to move up and down within the cavity 50 to allow air into the cavity 14 through cavity 46 or to seal off the passage.

The valve pluger 52 includes a sealing washer 54.

The cavity opposite the opening 46 includes an atmosphere opening 56. At the upper end of the body 48 there is an enlarged annular flange 58 adapted to receive a vent cap 60.

In operation, when the valve plunger 52 is open, air will push down on the plunger 52 and pass under the cap 60 through vent openings 64 in the flange 58 through opening 56 around the vale plunger 52 and through opening 46 into cavity 14. This is to insure that there is pressure in the cavity 14 and neck cavity 18 to force water therein out the drain means generally designated 72. When there is water in the cavities 14 and 18 the pressure of the water overcomes air pressure an closes the valve plunger 52 where the washer 54 is sealed against the undercut of the body 48.

As seen in FIG. 1 there is threadably secured to the collar 34 an extension pipe 74 which projects into a wall of a building (not shown) and is long enough to terminate at the threaded end 76 through the wall and within the building out of the atmosphere into generally warmer surroundings.

Threadably mounted on threaded end 76 of pipe 74 is a valve seat fitting designated 78. The fitting 78 includes an interior valve sat 80 and a passage 82 which communicates with a pipe, not shown, to be threaded onto the fitting by threads 84. The pipe, not shown, would run to a water source, not shown.

Returning to the water control valve handle 30, projecting from the handle through the cavity 14, out opening 32 and through the pipe 74 is an elongated valve stem 86. The stem 86 terminates in valve head 88 and a sealing washer 90 is held to the stem by means of a screw 92. It may be appreciated that the pipe 74 and stem 86 may vary in length depending on the distance from the faucet mounting flange 38 to the interior of a building which is out of the whether elements.

In operation, when the handle 30 is turned as in FIG. 1 the valve head 88 and washer 90 are backed off from the valve seat 80 so that water may pass into the pipe 74, see arrows, and into cavity 14 into the neck cavity 18 for discharge to be explained. In order to close off the water supply the handle 30 is rotated and the stem is laterally shifted so that the washer 90 is seated against the seat 80.

At the nozzle or front end 24 of the neck portion 16 there is fitted an anti-siphon back flow preventer designated 98, see FIGS. 1 and 2.

The purpose of the preventer 98 is to prevent water within a hose 100 which is threaded and secured to the preventer 98 by means of a conventional threadable hose coupling 102 from flowing back into the faucet 10 when the water source is turned off or there is a water pressure drop in the line. In addition, the structure to be described is adapted to act as an anti-siphon means so that water in the hose 100 may exist through a plurality of openings 104 in the direction of the arrows, FIG. 2 in event of water pressure drop.

The preventer which may be of brass or other suitable material includes a body 105 with a threaded collar portion 106 that is secured on the threads 25. The collar 106 includes a plurality of water openings 104. On the opposite end from collar 106 is an exterior threaded end 108 to receive the conventional hose coupling 102. Extending through the preventer 98 is a bore 110 terminating at its lower end in a reduced diameter to provide an annular end flange 112.

Looking at FIGS. 1 and 2 it can be sen that the cavity 18 as it approaches end 24 is defined by an upper downward tapered wall portion 114 and a lower downwardly tapered wall portion 116. As the two wall portions 114 and 116 converge at the end 24 there is formed a restricted opening 118 for water to enter the preventer 98 and hose 100 A taper of fourteen degrees has been found acceptable for the wall portion 114 however the degree of taper is not critical as long as full drainage occurs.

Figure 5:
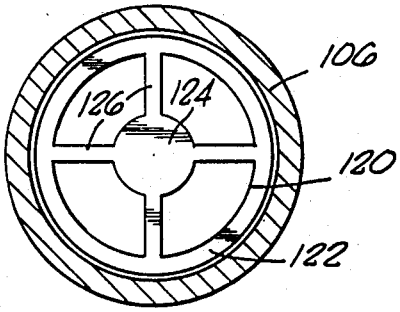

The back flow element of preventer 98 includes associated with the body 105 a sealing disc 120, see FIG. 5. The disc 120 includes an annular rim 122, a center plate seal seat 124 united to the rim 122 y spokes 126 with open area between the spokes for water to enter from the cavity 18. The disc 106 is adapted to fit within the threaded collar portion 106 and butt up against the end 24 of faucet 10. As can be seen in FIG. 2 there is a space 128 between end 24 and the disc 220 to allow water to pass. The disc 120 may be formed of metal such as brass or a relatively stiff plastic.

Figure 4:
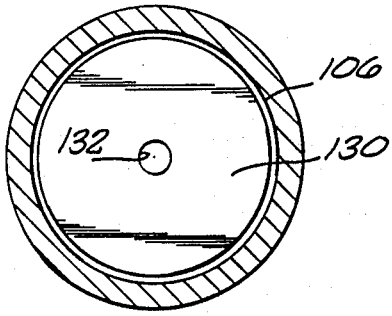
FIGS. 4 and 5 are elevational views taken on lines 4—4 and 5—5 respectively of FIG. 2 of other positions of the back flow preventer means.

Behind the disc 120 and adapted to contact the surface area of the disc 120 is a diaphragm 130, see FIG. 4. The diaphragm 130 has a central opening 132. Aligned behind the diaphragm 130 is a plunger seal 134 of metal or stiff plastic. The seal 134 has a central opening, unnumbered through which a locking pin 136 is inserted to maintain the seal in contact with a plunger 140. The plunger 140 includes an elongated guide shank 142.

Surrounding the guide shank 142 and biased against the annular flange 112 and the undersurface of plunger seal 134 is a compression spring 144.

In operation, when the handle 30 is open, water entering the cavity 18 will pass through the restricted opening 118 pushing against the diaphragm and passing out, see FIG. 1, around the plunger into the hose 100.

In order of the preventer 98 to prevent the back flow of water in the hose 100 into the cavity 18 the spring 144 will overcome the water pressure and urge the plunger 140, plunger seal 134 and diaphragm 130 against the sealing disc to seal the same and prevent water from flowing back into the cavity 18 and contaminating the water therein.

Finally, there is provided on the faucet 10, a drain fitting collar 150 which is internally threaded. The drain means 72 is preferably a metallic brass fitting including a threaded shank end 152 which is threaded into the collar 150. The fitting includes a central body portion 154 and may also include a lower discharge extension 156.

Figure 6:
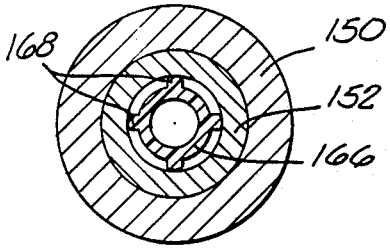
FIG. 6 is a cross sectional view taken on line 6—6 of FIG. 2 of a portion of the drain means.

Extending through the drain fitting is a stepped bore 158 with an upper annular interior shoulder 160 and a lower annular interior shoulder 162. Mounted within the bore 158 is a valve plunger 164 preferably of plastic having an annular body 166 with spacer fins 168 radiating outwardly toward the wall of bore 158, see FIG. 6. Projecting downwardly from the body 166 is a guide pin 170 and mounted around the guide pin 170 is a seal 172 which butts against the body 166.

Surrounding the guide pin 170 is a spring 174 biased between the seal 172 and the lower annular shoulder 162. The spring 174 is adapted to urge the drain body upward to an open position best seen in FIG. 2. In this position the drain being open, water within the cavities 14 and 18 will drain out around the body 164 between fins 168 and out the bore 158. As can be seen complete emptying of the faucet 10 is possible because the lower wall 116 slopping to the drain means 72 will assure no water will remain within the faucet 10. Thus when the water supply is closed off by the handle 30 there will be no pressure on the drain body 164 to overcome the spring 174 and with a complete evacuation of water there will be no freezing of water within the faucet because there will be no water therein..

When water is passing into the faucet 10 and into the cavities 14 and 18 it will be seen that the water pressure will overcome the spring 174 and push the body 166 downward to seat on upper annular shoulder 160 and seal the drain means 72 shut, as best seen in FIG. 1. In such a position water will be prevented from flowing out the drain.

In order for the drain means 72 to assume the open position of FIG. 2 it is necessary to vent the cavities 14 and 18 of the faucet, because without air inside there would be no overcoming the pressure build up therein. Therefore, when the water supply is shut off the vent means 45 is opened by gravity because there is no water pressure thereagainst so that air will flow into the faucet and the atmospheric pressure can act on the water therein, against body 164 and bias spring 174 to force open the drain means 72.

The invention and its attendant advantages will be understood from the foregoing description and it will be apparent that various changes may be made in the form, construction and arrangements of the parts without departing from the spirit and scope thereof or sacrificing its material advantages, the arrangements herein before described being merely by way of example. We do not wish to be restricted to the specific forms shown or uses mentioned, except as defined in the accompanying claims, wherein various portions have been separated for clarity of reading and not for emphasis.

We claim:

1. In an anti-siphon water faucet adapted for exterior building mounting wherein there is a body portion that includes a first water cavity and a neck portion that includes a second water cavity that communicates with said first cavity, a handle means including a valve stem projecting through said faucet terminating in a valve means and engagable with a valve seat coupled to a water supply, and said neck portion including a threaded end portion, the improvement including:

an anti-siphon water backflow fitting secured to said threaded neck portion and adapted to receive a hose coupling, said fitting including valve means that are movable from an open position when said source of water is on and biased shut when said water source is off to prevent water from back flowing into said faucet, and anti-siphon means in the form of a plurality of openings in said fitting communicating with the atmosphere to allow water to flow out without entering said faucet should there be a water pressure drop an air vent means on said faucet body having a bore that communicates with one of said cavities including a valve plunger movable from a closed position during the introduction of water from said water source to an open air intake position when said water supply to said faucet is terminated so that air may enter said cavities;

a water drain means fitted to said neck portion that includes a bore communicating with said second cavity and said means includes a water valve means that is shiftable from a closed position when said water source is supplying water into said faucet to an open water draining position when said water source to said faucet is shut off, and biasing means to urge said valve means to said open position.

2. A water faucet as defined in claim 1 wherein said neck portion includes:

an internally threaded drain collar that communicates with said second cavity; and said water drain means includes a drain fitting threadable mounted in said drain fitting collar, said fitting having a water discharge bore therethrough with a sealing flange therein, said water valve means adapted to seat on said flange in said bore in a closed position and said biasing means is a spring.

3. A water faucet as defined in claim 2 wherein said water valve means includes:

an annular valve plunger having fins radiating outward from said plunger adopted to engage the wall of said bore and form water passages therebetween, said plunger including a guide pin projecting downwardly therefrom and of a diameter less than the diameter of said plunger; and an annular seal on said plunger adapted to move with said plunger from said open position to said sealing position against said sealing flange.

4. A water faucet as defined in claim 2 wherein said second cavity includes:

a bottom wall slopped downward from said threaded end portion of said neck portion to said drain fitting collar whereby water within said second cavity may be completely evacuated through said drain means.

5. An anti-siphon frost free water faucet adapted for exterior building mounting comprising a body portion that includes a first water cavity and a neck portion having a threaded end portion and including a second water cavity that communicates with said first water cavity;

an elongated water pipe projecting from said body and communicating with said first water cavity, said elongated water pipe terminating in a valve seat and said pipe is coupled to a water source and said pipe adapted to extend through a wall of said building to the interior to assist in preventing water from freezing within said faucet;

a handle means for controlling the flow of water from said water source, an elongated valve stem projecting through said first water cavity and into said elongated water pipe, said valve stem including a valve means adapted to engage said valve seat;

an anti-siphon water back flow fitting threadably secured to said neck portion and adapted to receive a hose coupling, said fitting including valve means movable from an open water passing position when said water source is activated to a water closed position to prevent back flow into said cavities, air intake apparatus communicating with the interior of said fitting to bleed water from said fitting to prevent water backflow into said body due to a drop in water pressure during an on operation of said faucet;

an air vent means on said body communicating with one of said cavities including a valve plunger moveable from a closed position during the introduction of water from said water source to an open air intake position when said water source is terminated so air may enter said cavities; and a water drain means fitted to said neck portion that communicates with said second cavity, said drain means includes a drain fitting having a bore therethrough, a water valve means mounted in said fitting wherein said valve means is shiftable from a closed position during the introduction of water from said water source to an open water draining position when said water source is terminated, and biasing means to normally urge said water valve means to said open position.

6. An anti-siphon frost free water faucet as defined in claim 5 wherein said second cavity includes:

a bottom wall slopped downwardly from said threaded end portion of said neck portion to said drain fitting whereby water within said second cavity may be completely evacuated through said drain means to lessen the event of water freezing in said body.

7. An anti-siphon frost free water faucet as defined in claim 5 wherein said water valve means includes:

an annular valve plunger having fins radiating outward from said plunger adapted to engage the wall of said bore and form water passages therebetween, said plunger including a guide rim projecting downwardly therefrom and of a diameter less than the diameter of said plunger; and an annular seal on said plunger adapted to move with said plunger from said open position to said sealing position against said sealing flange.

* * * * *